US007956757B2

(12) United States Patent
Kumar et al.

(10) Patent No.: US 7,956,757 B2
(45) Date of Patent: Jun. 7, 2011

(54) SYSTEM AND METHOD FOR MONITORING AN ALERTNESS OF AN OPERATOR OF A POWERED SYSTEM

(75) Inventors: Ajith Kuttannair Kumar, Erie, PA (US); Jason Dean, Erie, PA (US); Patricia Lacy, Edinboro, PA (US); Christopher McNally, Girard, PA (US)

(73) Assignee: General Electric Company, Schenectady, NY (US)

( * ) Notice: Subject to any disclaimer, the term of this patent is extended or adjusted under 35 U.S.C. 154(b) by 263 days.

(21) Appl. No.: 12/183,352

(22) Filed: Jul. 31, 2008

(65) Prior Publication Data

US 2009/0267777 A1 Oct. 29, 2009

Related U.S. Application Data

(60) Provisional application No. 61/048,282, filed on Apr. 28, 2008.

(51) Int. Cl.
*G08B 23/00* (2006.01)

(52) U.S. Cl. ..... 340/576; 180/272

(58) Field of Classification Search ..... 340/576; 180/272

See application file for complete search history.

(56) References Cited

U.S. PATENT DOCUMENTS

| | | | | |
|---|---|---|---|---|
| 3,876,940 | A | 4/1975 | Wickford et al. | |
| 4,100,529 | A | 7/1978 | Evans | |
| 4,238,778 | A | 12/1980 | Ohsumi | |
| 4,359,725 | A * | 11/1982 | Balogh et al. | 340/576 |
| 4,942,395 | A | 7/1990 | Ferrari et al. | |
| 5,392,030 | A * | 2/1995 | Adams | 340/576 |
| 5,488,353 | A * | 1/1996 | Kawakami et al. | 340/576 |
| 5,684,455 | A * | 11/1997 | Williams et al. | 340/439 |
| 5,714,925 | A * | 2/1998 | Lee et al. | 340/309.7 |
| 5,877,676 | A * | 3/1999 | Shankarappa | 340/309.7 |
| 6,070,098 | A * | 5/2000 | Moore-Ede et al. | 600/544 |
| 6,113,538 | A * | 9/2000 | Bowles et al. | 600/300 |
| 6,145,792 | A | 11/2000 | Penza et al. | |
| 7,119,696 | B2 * | 10/2006 | Borugian | 340/576 |
| 7,398,140 | B2 | 7/2008 | Kernwein et al. | |
| 7,652,583 | B2 * | 1/2010 | Sanchez et al. | 340/575 |
| 7,692,551 | B2 * | 4/2010 | Bonefas et al. | 340/575 |
| 7,710,279 | B1 * | 5/2010 | Fields | 340/575 |
| 2005/0068184 | A1 * | 3/2005 | Kane et al. | 340/576 |
| 2008/0231461 | A1 * | 9/2008 | Sanchez et al. | 340/575 |
| 2008/0291032 | A1 * | 11/2008 | Prokhorov et al. | 340/576 |
| 2009/0058624 | A1 * | 3/2009 | Kane et al. | 340/439 |

* cited by examiner

*Primary Examiner* — Eric M Blount

(74) *Attorney, Agent, or Firm* — Robert Wawrzyn, Esq.; Cian G. O'Brien, Esq.; Beusse Wolter Sanks Mora & Marie, P.A.

(57) ABSTRACT

A system is provided for monitoring an alertness of an operator of a powered system. The system includes a controller configured to initiate an alert countdown upon determining a lack of input received from the operator during an operation of the powered system. The controller is configured to communicate an alert to the operator during the alert countdown. Additionally, the controller is configured to measure a response time of the operator to the alert. A method is also provided for monitoring an alertness of an operator of a powered system.

10 Claims, 5 Drawing Sheets

SYSTEM AND METHOD FOR MONITORING AN ALERTNESS OF AN OPERATOR OF A POWERED SYSTEM

CROSS-REFERENCE TO RELATED APPLICATIONS

This application claims priority to U.S. Provisional Application No. 61/048,282 filed Apr. 28, 2008 and incorporated herein by reference in its entirety.

BACKGROUND OF THE INVENTION

This invention relates to a powered system, such as a train, an off-highway vehicle, a marine vessel, a transport vehicle, an agriculture vehicle, and/or a stationary powered system and, more particularly to a system and method for monitoring an operator of a powered system.

Some powered systems such as, but not limited to, off-highway vehicles, marine diesel powered propulsion plants, transport vehicles such as transport buses, agricultural vehicles, and rail vehicle systems or trains, are powered by one or more diesel power units, or diesel-fueled power generating units. With respect to rail vehicle systems, a diesel power unit is usually a part of at least one locomotive powered by at least one diesel internal combustion engine, and with the locomotive being part of a train that further includes a plurality of rail cars, such as freight cars. Usually more than one locomotive is provided, wherein a group of locomotives is commonly referred to as a locomotive "consist." Locomotives are complex systems with numerous subsystems, with each subsystem being interdependent on other subsystems.

In order to ensure the proper operation of the powered system, such as a locomotive, for example, the operator must be sufficiently alert. More particularly, the operator should be cognizant of information related to the operation of the locomotive. Even if the locomotive is in an automatic mode in which a controller automatically determines locomotive parameters, such as engine notch (throttle setting) at each location along a predetermined route, based on parameters of the locomotive and parameters of the upcoming route, for example, the operator still should be cognizant of information related to the operation of the locomotive. Even during the automatic mode of the locomotive, the operator typically remains responsible for such tasks as monitoring light signals along the route and communicating with a dispatch center, for example.

Conventional systems have been proposed which attempt to ensure that the operator of a powered system, such as a locomotive, is sufficiently alert to operate the locomotive. However, these conventional systems have several shortcomings. For example, these conventional systems typically require that the operator merely push a reset button during a countdown, a simple action which could be performed by an operator who may not be sufficiently alert and/or cognizant of information related to the operation of the locomotive. Such a simple action is not indicative of whether the operator is cognizant of information related to the operation of the locomotive. Conventional systems may also exist wherein the operator is required to enter the status of the signal aspect information but does not verify the accuracy of this entry.

BRIEF DESCRIPTION OF THE INVENTION

One embodiment of the present invention provides a system for monitoring an alertness of an operator of a powered system. The system includes a controller configured to initiate an alert countdown upon determining a lack of input received from the operator during an operation of the powered system. The controller is configured to communicate an alert to the operator during the alert countdown. Additionally, the controller is configured to measure a response time of the operator to the alert. In this manner, the system advantageously monitors the response of the operator while simultaneously ensuring that the operator is cognizant of information related to the operation of the locomotive.

Another embodiment of the present invention provides a system for monitoring an alertness of an operator of a powered system. The powered system travels along a predetermined route. The system includes a controller configured to initiate a query to the operator during an operation of the powered system. The query is configured to prompt the operator for information related to the operation of the powered system along the route. The controller is configured to compare a response to the query with a correct answer to the query to determine the alertness of the operator.

Another embodiment of the present invention provides a method for monitoring an alertness of an operator of a powered system. The method includes determining a lack of input received from the operator during an operation of the powered system. The method further includes initiating an alert countdown based upon the lack of input received. The method further includes communicating an alert to the operator during the alert countdown. Additionally, the method includes measuring a response time of the operator to the alert.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
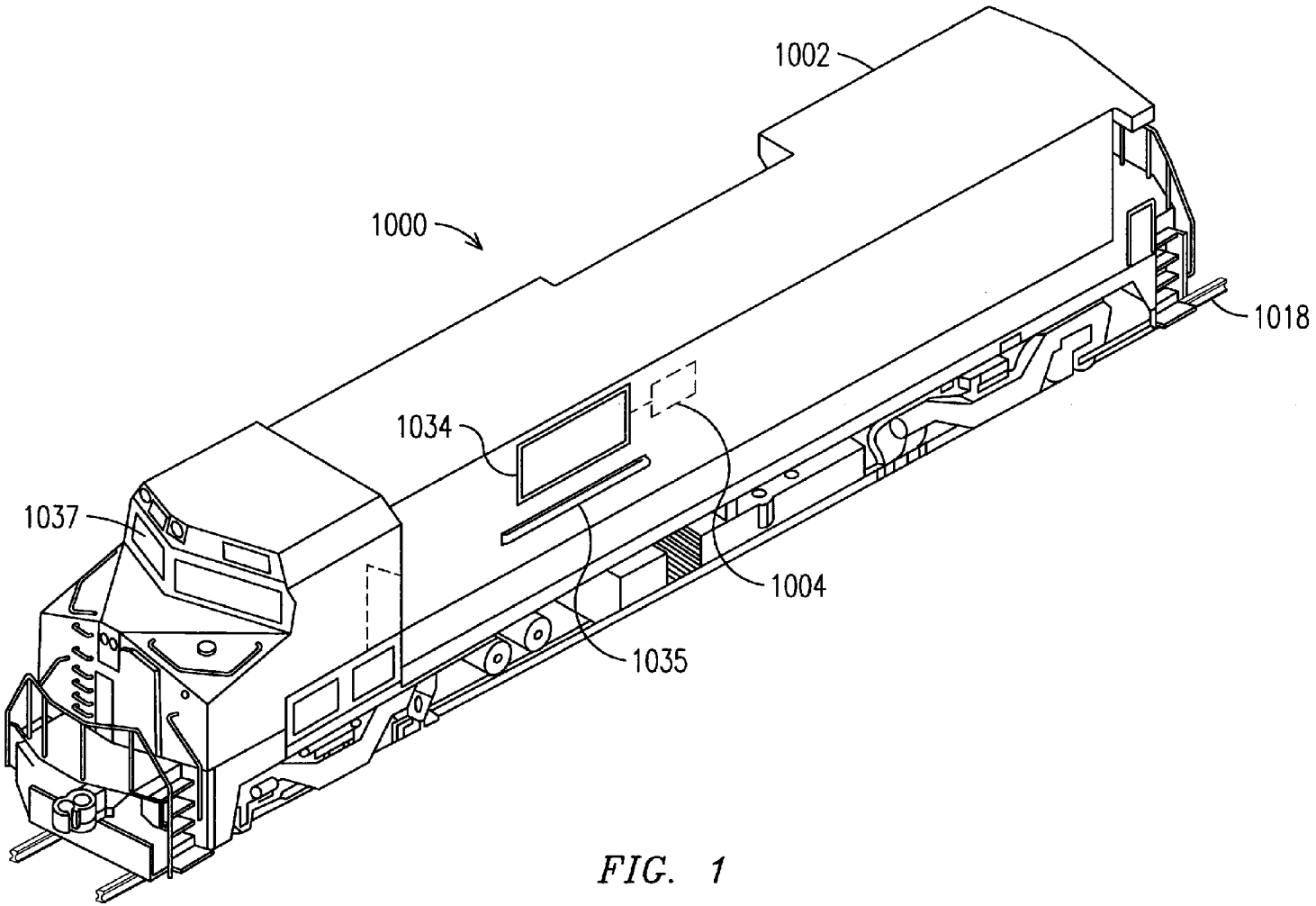
FIG. 1 is a top perspective view of an exemplary embodiment of a system for monitoring an alertness of an operator of a powered system.

Reference will now be made in detail to the embodiments consistent with the invention, examples of which are illustrated in the accompanying drawings. Wherever possible, the same reference numerals used throughout the drawings refer to the same or like parts.

Though exemplary embodiments of the present invention are described with respect to rail vehicles, or railway transportation systems, specifically trains and locomotives having diesel engines, exemplary embodiments of the invention are also applicable for use with other powered systems, such as but not limited to off-highway vehicles, marine vessels, agricultural vehicles, transport buses, and other vehicles, and stationary power generation systems, each which may use at least one diesel engine, or diesel internal combustion engine, or other engine. Towards this end, when discussing a specified mission, this includes a task or requirement to be performed by the powered system.

Therefore, with respect to railway vehicles, marine vessels, transport vehicles, agricultural vehicles, or off-highway vehicle applications, this may refer to the movement of the powered system from a present location to a destination. In the case of stationary applications, such as but not limited to a stationary power generating station or a network of power generating stations, a specified mission may refer to an amount of wattage (e.g., MW/hr) or other parameter or requirement to be satisfied by the diesel powered system. Likewise, operating conditions of the diesel-fueled power generating unit may include one or more of speed, load, fueling value, timing, etc. Furthermore, although diesel powered systems are disclosed, those skilled in the art will readily recognize that embodiments of the invention may also be utilized with non-diesel powered systems, such as but not limited to natural gas powered systems, gasoline powered systems, bio-diesel powered systems, etc.

Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

In one embodiment involving marine vessels, a plurality of tugs may be operating together to move the same larger vessel, and where each tug is linked in time to accomplish the mission of moving the larger vessel. In another embodiment, a single marine vessel may have a plurality of engines. Off-highway vehicle (OHV) applications may involve a fleet of vehicles (e.g., mine trucks or other mining vehicles) that have a same mission to move earth, from location A to location B, where each OHV is linked in time to accomplish the mission. With respect to a stationary power generating station, a plurality of stations may be grouped together collectively generating power for a specific location and/or purpose. In another exemplary embodiment, a single station is provided, but with a plurality of generators making up the single station. In one example involving locomotive vehicles, a plurality of diesel powered systems may be operating together where all are moving the same larger load, and where each system is linked in time to accomplish the mission of moving the larger load. In another exemplary embodiment a locomotive vehicle may have more than one diesel powered system.

FIG. 1 illustrates an exemplary embodiment of a system 1000 for monitoring an alertness of an operator 1001 (FIG. 2) of a powered system, such as a train having a locomotive 1002, for example. The system 1000 includes a controller 1004 positioned on the locomotive 1002. The controller 1004 is configured to determine a lack of operator input during the operation of the locomotive 1002 by initiating an input countdown during which an input from the operator, such as varying the engine notch 1016 (FIG. 4), for example, while operating the locomotive 1002 resets the input countdown. In an exemplary embodiment, the input countdown may depend upon the speed of the locomotive 1002. For example, for an input countdown of 40 seconds at a speed of 60 mph, the operator 1001 would need to provide an input, such as varying the engine notch 1016, for example, within the 40 second input countdown, in order to reset the input countdown. The input countdown may be varied based on the responsiveness and/or alertness of the operator 1001, as discussed below.

Figure 3:
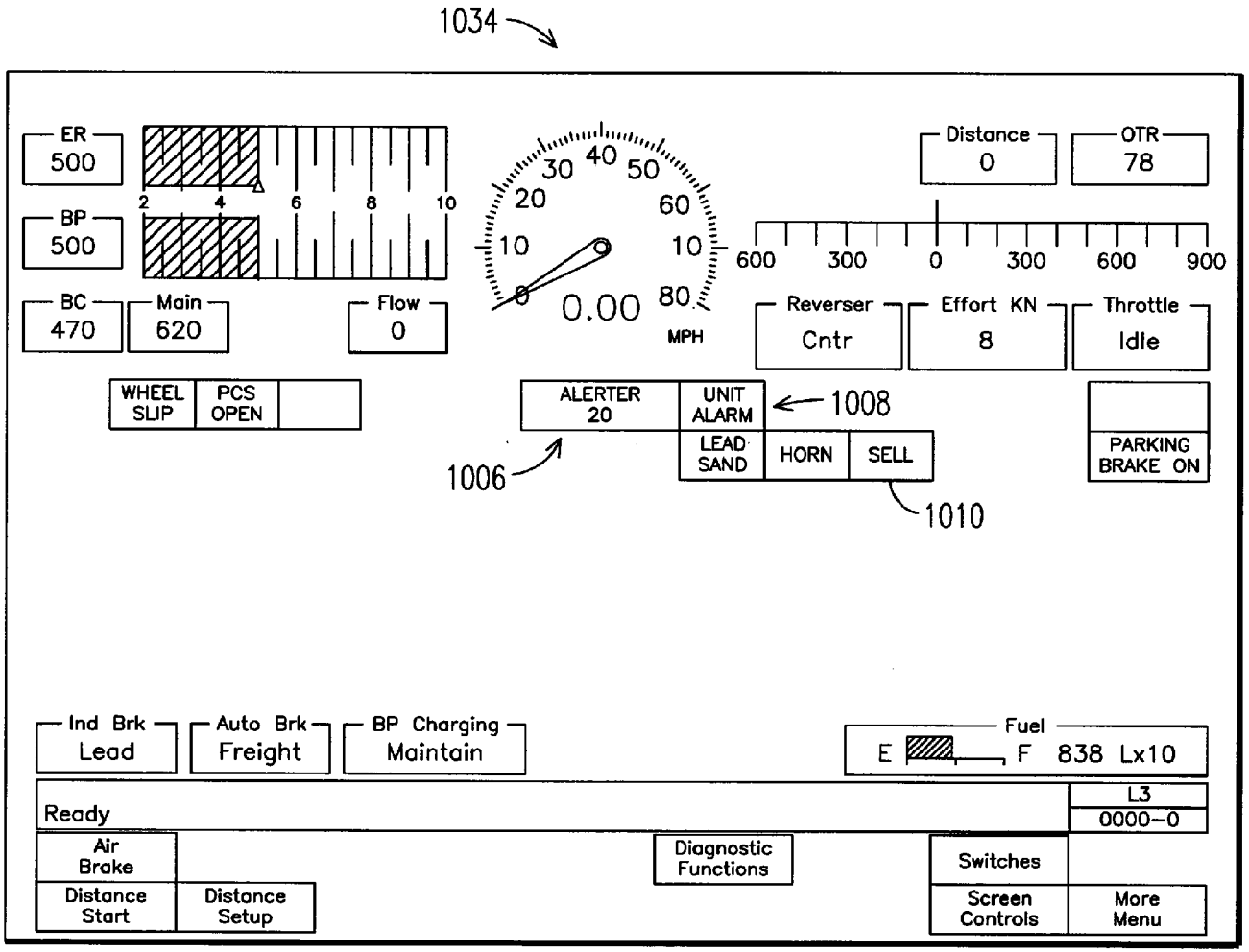
FIG. 3 is a plan view of an exemplary embodiment of an operator display within a system for monitoring an alertness of an operator of a powered system.

Upon determining the lack of input received from the operator 1001 during the input countdown (e.g., the input countdown lapses), the controller 1004 is configured to initiate an alert countdown 1006 (FIG. 3). During the alert countdown 1006, the controller 1004 communicates an alert 1008 (FIG. 3) to the operator 1001 through a display 1034. Additionally, the controller 1004 measures a response time of the operator 1001 to the alert, as discussed in greater detail below. If the operator 1001 fails to respond during the alert countdown 1006 (e.g., the alert countdown lapses), the controller 1004 may initiate a corrective action, such as initiating activation of a braking system to stop the locomotive 1002, switching the controller 1004 from an automatic mode to a manual mode, modifying the alert 1008 during the alert countdown 1006, modifying an input query to a more significant query, ring a bell, initiate an audible tone, and/or restricting a powered mode of an engine of the locomotive 1002 (e.g., restrict and/or reduce the engine notch).

Figure 2:
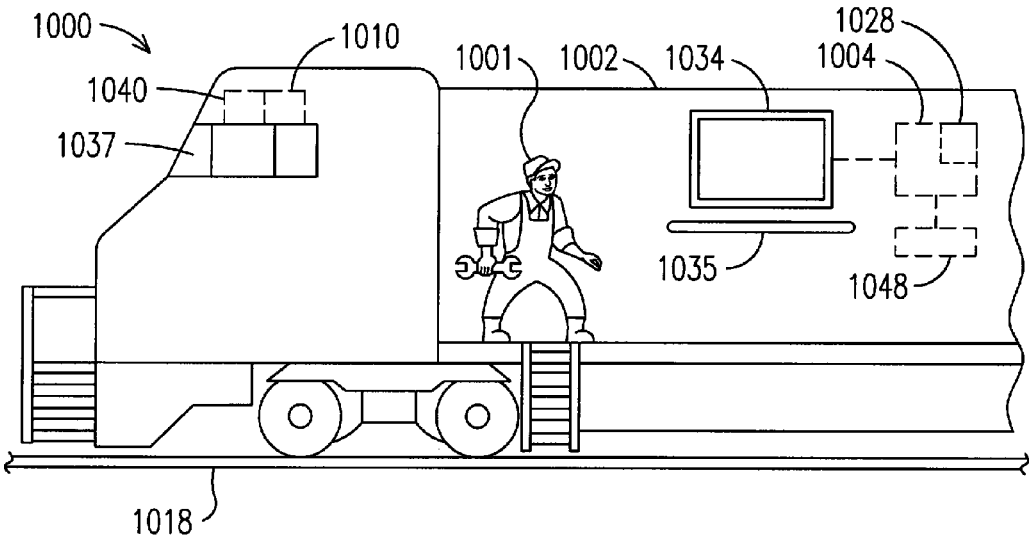
FIG. 2 is a side plan view of an exemplary embodiment of the system for monitoring an alertness of an operator of a powered system illustrated in FIG. 1.

The exemplary embodiment of FIG. 2 illustrates an operator 1001 such as an engineer, for example, who receives the alert 1008 from the controller 1004 through the display 1034, which is coupled to the controller 1004. The operator 1001, such as the engineer, may respond to the alert 1008 by inputting a response on a keypad 1035 adjacent to the display 1034 or by inputting the response using one or more softkeys 1024, 1036, 1038, 1039 (FIG. 4) on the display 1034, for example, as discussed in greater detail below. In addition to the engineer, the alertness of a conductor (not shown) may be similarly monitored by the system 1000. The conductor may be positioned within a conductor cabin 1037, and similarly receive such an alert 1008 from the controller 1004 through an audible device 1040 positioned within the conductor cabin 1037. The conductor may respond to the alert 1008 by activating the audible device 1040 a prescribed number of times or by activating a bell 1010, for example. For example, the controller 1004 may activate the audible device 1040 once, which may indicate to the conductor that the bell 1010 should be activated. Alternatively, a display may be positioned within the conductor cabin 1037 to visually communicate the alert 1008 to the conductor and for the conductor to respond to the alert using softkeys, for example.

In an exemplary embodiment, the controller 1004 may reduce the duration of the input countdown, and thus require that the operator 1001 provides more frequent input, or the controller 1004 will initiate the alert countdown 1006 if the reduced input countdown lapses. For example, the controller 1004 may reduce the duration of the input countdown if the response time of the operator 1001 during the alert countdown 1006 is greater than a predetermined threshold, which is stored in a memory 1028 of the controller 1004. For example, if the alert countdown is 25 seconds, the response time is 23 seconds, and the predetermined threshold is 20 seconds, the controller 1004 may reduce the duration of the input countdown. The predetermined threshold may depend on various factors, such as a parameter of the locomotive 1002, and a parameter of the railroad 1018 upon which the locomotive 1002 travels, for example. However, the predetermined threshold for the response time may be fixed or may be based on factors other than those listed above. In another exemplary embodiment, the controller 1004 stores the response time of each alert countdown in the memory 1028, and may reduce the duration of the input countdown if the response time for a number of consecutive alert countdowns continuously decreases. For example, if the operator 1001 response time for consecutive alert countdowns is 2 seconds, 10 seconds, and 20 seconds, the controller 1004 may reduce the duration of the input countdown. In an additional exemplary embodiment, upon determining that the response time is greater than the predetermined threshold stored in the memory 1028, the controller 1004 may reduce the duration of the alert countdown 1006, thereby requiring that the operator 1001 provides a response within a shorter time duration, or the controller 1004 will initiate corrective action, such as activating a braking system, for example.

As illustrated in the exemplary embodiment of FIG. 3, which is an example of a display 1034 viewed by an operator 1001, such as an engineer, for example, the alert 1008 may be an audible tone which is activated during the alert countdown 1006. If the response time of the operator 1001 during the alert countdown 1006 exceeds the predetermined threshold, the controller 1004 may increase the frequency and/or volume of the audible tone as the alert countdown 1006 proceeds. Alternatively, if the response time of the operator 1001 during the alert countdown 1006 exceeds the predetermined threshold, instead of activating an audible tone during the alert countdown 1006, the controller 1004 may activate a bell 1010 as the alert 1008. As appreciated by one of skill in the art, the bell 1010 is typically activated to indicate a failed system on the locomotive 1002, and thus may be used in an effort to alert the operator 1001 if the response time exceeds the predetermined threshold.

Figure 4:
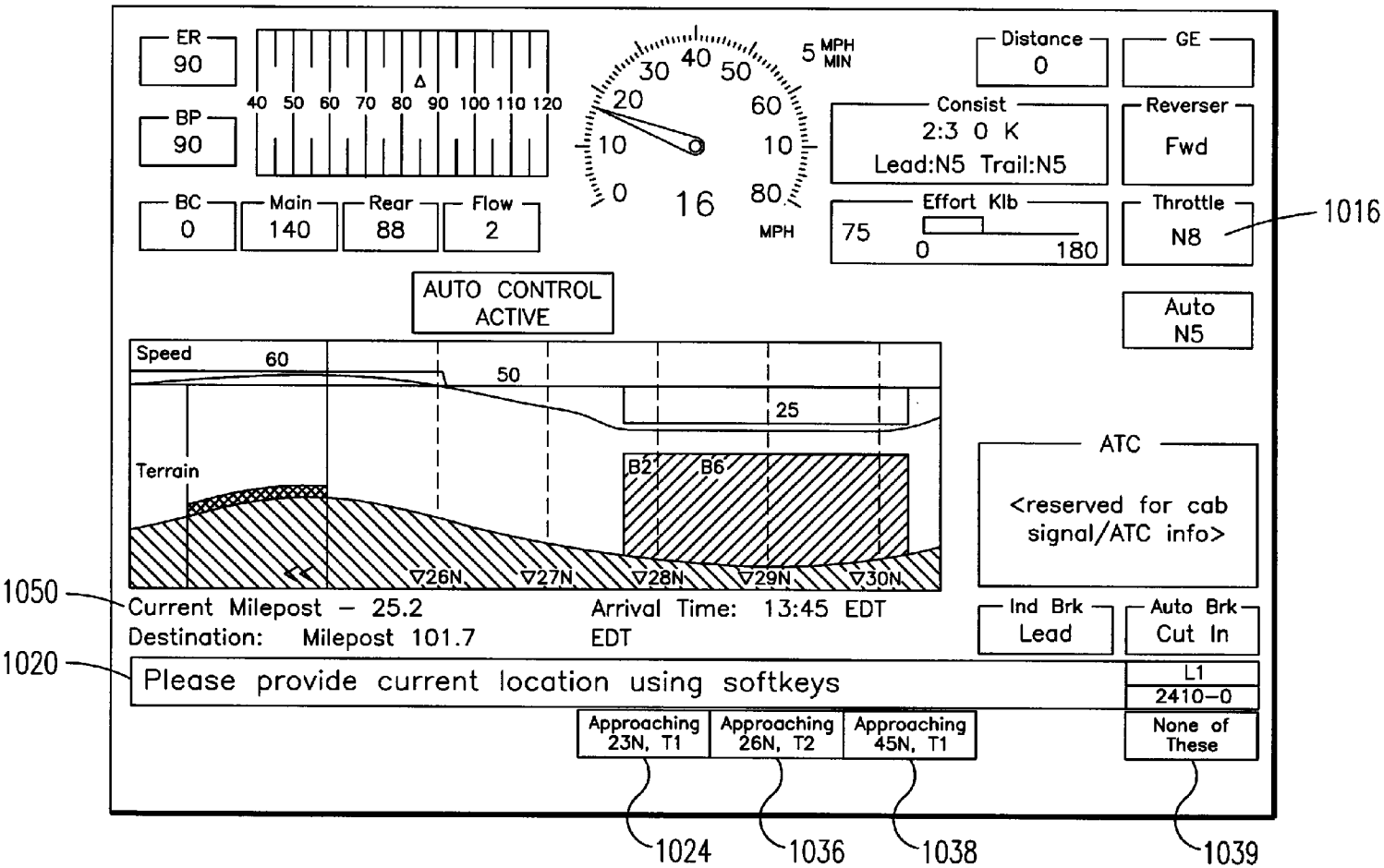
FIG. 4 is a plan view of an exemplary embodiment of an operator display within a system for monitoring an alertness of an operator of a powered system.

The exemplary embodiment of FIG. 4 illustrates an additional example of a display 1034, upon which the controller 1004 initiates a query based on the time of day (e.g., at 2 am), the length of time an operator 1001 has been on duty (e.g., toward the end of a shift), a geographic location (e.g., a mundane location), the characteristics of the locomotive 1002, the train type, the locomotive operating mode (e.g., automatic control or dynamic braking), previous query accuracy, response time to a previous query, a random basis, and/or upon determining a lack of input received from the operator 1001 during an operation of the locomotive 1002. During the query, the controller 1004 prompts the operator 1001 with a query 1020 for information related to the operation of the locomotive 1002 along the railroad 1018. Additionally, the controller 1004 may prompt the operator 1001 with a query 1020 containing information about which the operator 1001 should be cognizant in the proper operation of the locomotive 1002. In the exemplary embodiment of FIG. 4, the query 1020 requests that the operator 1001 provide the current location of the locomotive 1002 along the railroad 1018 using one of the softkeys 1024, 1036, 1038, 1039. Provided that the operator 1001 is adequately alert and cognizant of information related to the proper operation of the locomotive 1002 along the railroad 1018, the operator 1001 will select the softkey 1036 "approaching 26N," as the current milepost 1050 is 25.2, as indicated in the display 1034. Although the display 1034 indicates the current milepost 1050, the operator 1001 should be cognizant of the information requested in the query 1020 independent of the display 1034.

In an exemplary embodiment, when the controller 1004 is in an automatic mode, the controller 1004 predetermines an operating parameter for the locomotive 1002 at incremental locations along the predetermined route. As the locomotive 1002 travels along the predetermined route, the operator 1001 needs to be sufficiently alert to ensure that the current operating parameter of the locomotive 1002 conforms with the predetermined operating parameter at each incremental location. Thus, an effective query to determine the alertness of the operator 1001 involves prompting the operator 1001 for a predetermined operating parameter at a current location of the locomotive 1002, for example. Upon receiving the operator's 1001 response, the controller 1004 subsequently compares the operator's 1001 response with the actual predetermined operating parameter at that location, which is stored in the memory 1028 of the controller 1004.

Once the operator 1001 has inputted a response to the query 1020, the controller 1004 compares the response to the query 1020 with a correct answer to the query 1020, which is stored in the memory 1028 of the controller 1004. Based upon the comparison of the response with the correct answer, the controller 1004 determines the alertness of the operator 1001 in operating the locomotive 1002. The queries 1020 may include any information related to the operation of the locomotive 1002. In an exemplary embodiment, such information may be categorized from high significance to low significance, based on the importance of the operator 1001 having cognizant knowledge of this information in the operation of the locomotive 1002. In an exemplary embodiment, the categories of such information, in order of decreasing significance, include a current mile posting and a current speed limit; the next slow order; a most recent geographic crossing with the railroad; a most recent train having passed on an adjacent railroad; a transmitter message, such as a hot box detector message, for example, including a transmitter identifier, a mile posting, and a number of wheels on the train; a most recent communication from a dispatch center; and a parameter of the train.

In order to ensure an adequate monitoring of the alertness of the operator 1001, the controller 1004 is configured to query the operator 1001 with information from any of the above categories. As discussed above, the operator queries may be initiated based on the time of day, the extent of time on duty, a responsiveness of the operator 1001 to the alerter countdown time, an accuracy of the operator 1001 to previous queries, a query response time, a geographical location, or in a random fashion. However, in an exemplary embodiment, the controller 1004 may be configured to query information from categories of higher significance (e.g., current mile posting/speed limit) more often than categories of lower significance (e.g., a train parameter). In an additional exemplary embodiment, the memory 1028 of the controller 1004 may store an acceptable error for each correct response to a query 1020, used to determine whether a response indicates a sufficient level of alertness. The acceptable error may be lower for those categories of higher significance. For example, if an operator 1001 is queried with the length of the train, provides a response of 5500 feet, and the correct answer is 6000 feet, this response may be deemed to be within an acceptable error. However, if an operator 1001 is queried with the current speed limit, provides 45 mph, and the correct answer is 50 mph, this response may be deemed to be outside the acceptable error, despite being relatively closer than the response to the length of the train query, since the acceptable error for the current speed limit is relatively small, as it is information of greater significance in terms of operator alertness. In an additional exemplary embodiment, if an operator provides an incorrect response to a query from a low category of significance, the controller may subsequently query the operator with information from a higher category of significance.

In an additional exemplary embodiment, the controller 1004 stores the response of the queries 1020 in the memory 1028, along with the identity of the operator 1001, the location of the locomotive 1002 during the query, the time of day during the query, and one or more parameters of the locomotive 1002 during the query. The controller 1004 may communicate the query data stored in the memory 1028, along with the respective operator identity, locomotive location, time of day, and/or locomotive parameter during the query to a dispatch center or remote party for analysis, for example. Additionally, a plurality of locomotives may store the queries of their respective operators in a respective memory of the controller, and may communicate the respective query data, along with the operator identity, locomotive location, time of day, and/or locomotive parameter during the query, to a dispatch center or third party for analysis. For example, the controller(s) may communicate this information to a dispatch station that controls the light signals along the railroad; a third party, such as a road foreman, who is responsible for maintaining the safe performance of the operators; and/or to an event recorder 1048 coupled to the controller 1004 to record the responsiveness of the operator 1001 for subsequent analysis.

Figure 5:
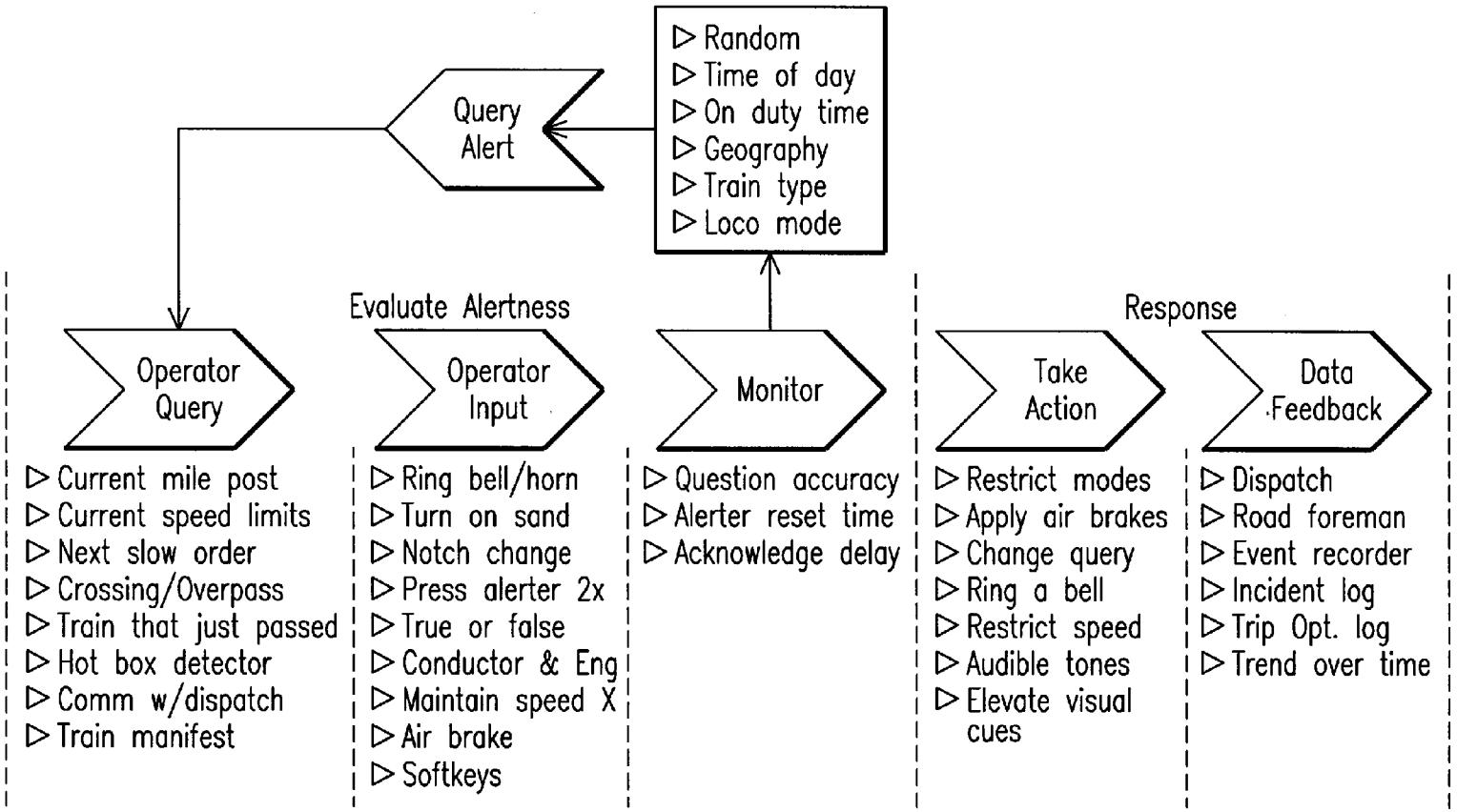
FIG. 5 is a schematic diagram of an exemplary embodiment of a system for monitoring an alertness of an operator of a powered system.

FIG. 5 illustrates an exemplary schematic diagram of a system for monitoring an alertness of an operator 1001 of a locomotive 1002. As discussed above, the query may be initiated based on the time of day, the extent of time that the operator 1001 has spent on duty, a geographic location, the type of locomotive/train being operated, locomotive operating mode, previous query accuracy or response time, alerter reset timeliness, and/or on a random basis. Once the query has initiated, the operator is queried with information from a number of categories from high to low significance: current mile post, current speed limit, next slow order, the most recent crossing/overpass, the most recent train having passed on an adjacent track, the most recent hot box detector message, the most recent communication with dispatch, and/or information from the train manifest. In addition to responding to the query (using softkeys on a display, for example), the operator may be requested to provide various inputs within a fixed alert countdown, such as ringing a horn/bell, turning on a sander, changing an engine notch, pressing an alert button twice, selecting a true/false answer using an input device, air brake setting, and/or maintaining a speed of the locomotive, for example. The system is designed to monitor the alertness of the operator, including the engineer and the conductor, for example, by evaluating the accuracy of the query response, the response time during an alert countdown, and evaluating the operator's performance over time. In response to the operator query and operator inputs, the system may take various corrective action(s), such as restricting the modes of an engine of the locomotive, applying a braking system such as air brakes, changing the query information, ringing a bell, elevate visual cues, sound specific audible tones, and/or restricting the locomotive/train speed. Subsequent to corrective action(s), the system may provide data feedback of the operator query and operator input monitored responses, to a dispatch center, a road foreman, an event recorder, an incident log, and/or a trip optimizer log, for example.

Figure 6:
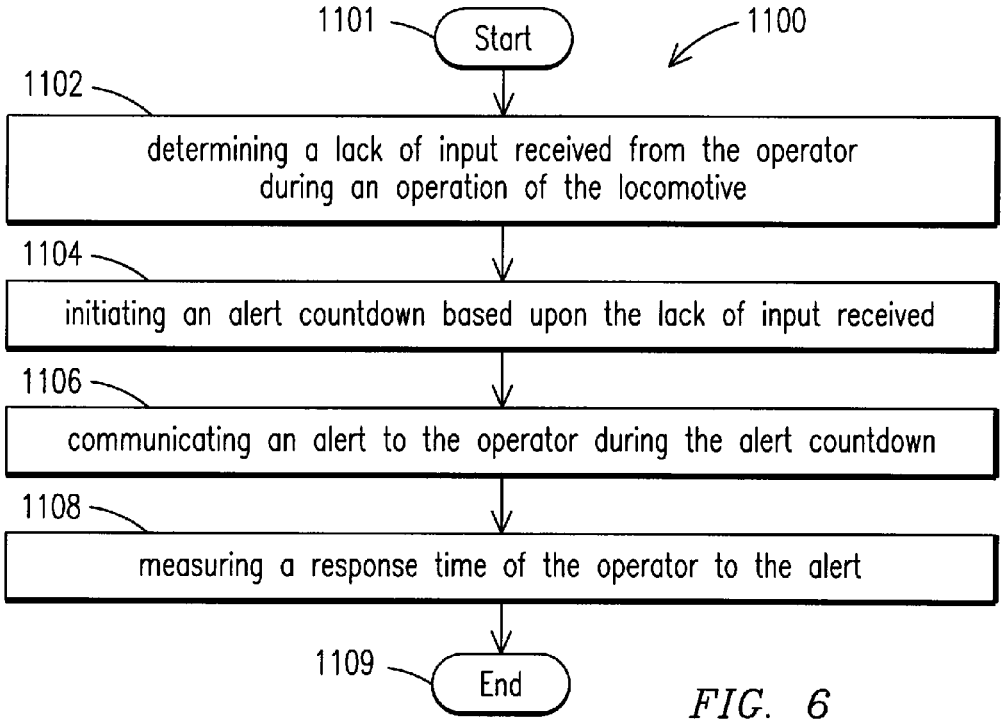
FIG. 6 is a flow chart illustrating an exemplary embodiment of a method for monitoring an alertness of an operator of a powered system.

FIG. 6 illustrates an exemplary embodiment of a method 1100 for monitoring an alertness of an operator 1001 of a locomotive 1002. The method 1100 may begin at 1101 by determining 1102 a lack of input received from the operator 1001 during an operation of the locomotive 1002 and/or in response to queries initiated based on time of day, time on duty, responsiveness to alerter countdown time, an accuracy to previous queries, a query response time, an operating mode, a geographical location, and/or in a random fashion. Additionally, the method 1100 includes initiating 1104 an alert countdown 1006 based upon the lack of input received. The method 1100 further includes communicating 1106 an alert 1008 to the operator 1001 during the alert countdown 1006. The method 1100 further includes measuring 1108 a response time of the operator 1001 to the alert 1008, before ending at 1109.

While the invention has been described with reference to exemplary embodiments thereof, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. For example, one of skill in the art may customize the queries based on the operator identity, the type of train, the time of day, the geographic location, and other factors based on ensuring the alertness of an operator, and the particular needs of one of skill in the art who may be responsible for monitoring the alertness of the operators. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A system for monitoring an alertness of an operator of a powered system, said powered system operating based on a profile, said monitoring system comprising:

a controller configured to initiate a query to the operator during an operation of the powered system, said query is configured to prompt the operator for information related to the operation of the powered system along the profile; and said controller being configured to compare a response to the query with a correct answer of said query to determine the alertness of the operator;

wherein said information related to the operation of the powered system includes a plurality of categories of varying significance, and said controller is configured to query the operator with information from one of said categories.

2. The system of claim 1, wherein upon the operator having provided an incorrect response to a query from a first category, said controller is configured to query the operator with information from a second category of higher significance than said first category.

3. The system of claim 1, wherein said controller is configured to randomly query the operator with information related to the operation of the powered system from a category of high significance more often than a category of low significance.

4. The system of claim 1, wherein said controller includes a memory configured to store said correct answer to the query and an acceptable error of the response to said query; said controller is configured to determine the alertness of the operator based upon said response, said correct answer, and said acceptable error of the response; and said acceptable error is lower for a category of higher significance than said acceptable error for a category of lower significance.

5. The system of claim 1, wherein said powered system is a train traveling along a railroad, and said plurality of categories in decreasing order of significance include at least one of:

a current operating parameter of the train;

a current location of the train;

an identity of a passing train on an adjacent railroad;

a transmitted message provided by a wayside device; and/or a communication received from a dispatch center.

6. The system of claim 1, wherein said powered system is a train traveling along a railroad, and said plurality of categories in decreasing order of significance include at least one of:

one of a current mile posting and a current speed limit;

a geographic crossing with the railroad;

a train having passed on an adjacent railroad;

a transmitter message provided by a transmitter positioned adjacent to the railroad, said transmitter message including a transmitter identifier, a mile posting, and a number of wheels on the train;

a most recent communication from a dispatch center; and/or a parameter of the train.

7. A system for monitoring an alertness of an operator of a powered system, said monitoring system comprising:

a controller configured to initiate an alert countdown upon determining a lack of input received from the operator during an operation of the powered system, said controller being configured to communicate an alert to the operator during said alert countdown, and to measure a response time of the operator to said alert;

a memory coupled to the controller, said memory containing data relating to the correct answer to the query, wherein the controller is configured to compare the response and the correct answer to determine the alertness of the operator; and a display coupled to the controller to output the query, said display including a softkey for the operator to input the response.

8. The system of claim 7, wherein:

said powered system is a train traveling along a railroad, and the operator is one of an engineer and a conductor;

a query is output to the engineer through the display, and the engineer inputs the response to the query using the softkey of the display;

said controller is coupled to an audible device in a conductor cabin; and a conductor query is output to the conductor using the audible device, and said conductor inputs the query by activating one of a bell and the audible device.

9. A system for monitoring an alertness of an operator of a powered system, said monitoring system comprising:

a controller configured to initiate an alert countdown upon determining a lack of input received from the operator during an operation of the powered system, said controller being configured to communicate an alert to the operator during said alert countdown, and to measure a response time of the operator to said alert wherein said controller is configured to store the response to the query in a memory of the controller, in addition to at least one of an identity of the operator, a location of the powered system during the query, a time of day of the query, and/or a parameter of the powered system during the query.

10. The system of claim 9, wherein each of a plurality of powered systems include a respective controller configured to store a respective query in a respective memory of the controller; said respective controller of the plurality of powered systems is configured to communicate said respective query response along with at least one of the operator identity, a respective powered system location, the time of day, and the powered system parameter for the respective query response to at least one of a:

dispatch station configured to control a plurality of light signals along a route;

a road foreman responsible for maintaining a safe performance of the operator; and an event recorder coupled to the memory.

* * * * *